United States Patent [19]

Romanenko et al.

[11] 3,961,481

[45] June 8, 1976

[54] ARRANGEMENT FOR RETAINING AN ACTUATING MEMBER IN AN EXTREME POSITION

[76] Inventors: Nikolai Trofimovich Romanenko, Tokmakov pereulok, 13-15, kv. 165; Jury Filippovich Nikitin, ulitsa Arbat, 18, kv. 31; Ljudmila Anatolievna Litenkova, Bashilovskaya ulitsa 19, kv. 158, all of Moscow, U.S.S.R.

[22] Filed: Mar. 24, 1975

[21] Appl. No.: 561,076

Related U.S. Application Data

[63] Continuation of Ser. No. 499,075, Aug. 20, 1974, abandoned, which is a continuation of Ser. No. 378,904, July 13, 1973, abandoned.

[30] Foreign Application Priority Data

July 13, 1972 U.S.S.R. ..... 1808784

[52] U.S. Cl. ..... 60/531; 337/140; 251/11

[51] Int. Cl.[2] ..... F03C 5/00

[58] Field of Search ..... 60/531; 251/11; 337/140

[56] References Cited

UNITED STATES PATENTS

| | | | |
|---|---|---|---|
| 2,678,362 | 5/1954 | Bescocca | 337/140 X |
| 2,815,882 | 12/1957 | Connell | 251/11 UX |
| 3,541,920 | 11/1970 | Rapp et al. | 185/37 X |

*Primary Examiner*—Martin P. Schwadron
*Assistant Examiner*—H. Burks, Sr.
*Attorney, Agent, or Firm*—Holman & Stern

[57] ABSTRACT

An arrangement for retaining an actuating member in an extreme position which has a connecting element held in permanent engagement with the actuating member and received between a pair of supports to which the connecting element is pressed by at least one coil of wire wound about the supports with an effort sufficient for retaining the actuating member in its extreme position. The wire is selectively connectable to a source of power so that the wire is heated up whereby the pressure of the supports against the connecting element is reduced, and the connecting element is released to move relative to the supports, thus releasing the actuating member, so that the latter moves through its working stroke.

1 Claim, 2 Drawing Figures

ARRANGEMENT FOR RETAINING AN ACTUATING MEMBER IN AN EXTREME POSITION

This is a continuation of application Ser. No. 499,075 filed Aug. 20, 1974 which in turn is a Rule 60 Continuation of Application Ser. No. 378,904, filed July 13, 1973, now abandoned.

BACKGROUND OF THE INVENTION

The present invention relates to arrangements for retaining an actuating member in an extreme position and for selectively releasing the actuating member.

An arrangement constructed in accordance with the present invention may be employed in hydraulic and pneumatic systems, wherever it is essential that the actuating member should be displaced at a high rate, e.g. in a valve in an emergency protection system, during fire-fighting, and during ejection from an aircraft, etc.

Furthermore, such arrangements may be used in emergency protection systems of electric power networks.

Already known are various arrangements for retaining an actuating member in an extreme position and for selectively releasing this member to perform a working stroke.

A known arrangement includes a housing receiving therein a pair of supports, one of the supports being secured in the housing and the other support being connected with a spring-biased connecting member held in permanent contact with the actuating member, e.g. with a valve of a hydraulic system. Wound between these two supports is at least one coil of wire selectively connectable to a power supply source.

The connecting link is in permanent contact with the actuating member to retain the latter in its extreme position, e.g. to retain a valve in a closed state. To release the actuating member, i.e. to open the valve, the wire coil is connected to the power supply source. As electric current then flows through the wire the latter heats up and expands as a result, whereby the support having the spring-biased connecting member attached thereto is displaced and moves the connecting member out of engagement with the acutating member, whereby the latter is released to perform a working stroke.

A disadvantage of the abovedescribed known arrangement is that the displacement of the connecting member cooperating with the actuating member is in direct proportion to the length of the wire coil, which leads to the necessity of increasing the dimensions of the arrangement, and, consequently, to its increased cost.

SUMMARY OF THE INVENTION

It is an object of the present invention to reduce the dimensions of known arrangements for retaining an actuating member in an extreme position.

It is another object of the present invention to bring down the cost of manufacture of such arrangements.

It is still another object of the present invention to reduce the amount of electric power consumed by such arrangements.

With these and other objects in view, an arrangement according to the invention, for retaining an actuating member in an extreme position thereof and for selectively releasing the actuating member to perform a working stroke under the action of a positively biased connecting member displaceable in the course of heating of at least one coil of wire connectable to a source of power and wound about supports arranged in a housing, in which arrangement, in accordance with the present invention, the connecting member is positioned between the supports and is pressed thereagainst by the at least one coil of wire with an effort sufficient for retaining the actuating member in the extreme position thereof.

An arrangement for retaining an actuating member in an extreme position thereof and for selectively releasing the actuating member, in accordance with the present invention, combines relatively small size with a relatively great stroke of the connecting element acting upon the actuating member. In this arrangement the displacement of the connecting element does not depend on the length of the coil of wire.

BRIEF DESCRIPTION OF THE DRAWINGS

Other objects and advantages of the present invention will become apparent in the following detailed description of an embodiment of the invention, with reference being had to the accompanying set of drawings, wherein.

DETAILED DESCRIPTION OF PREFERRED EMBODIMENTS

Figure 1:
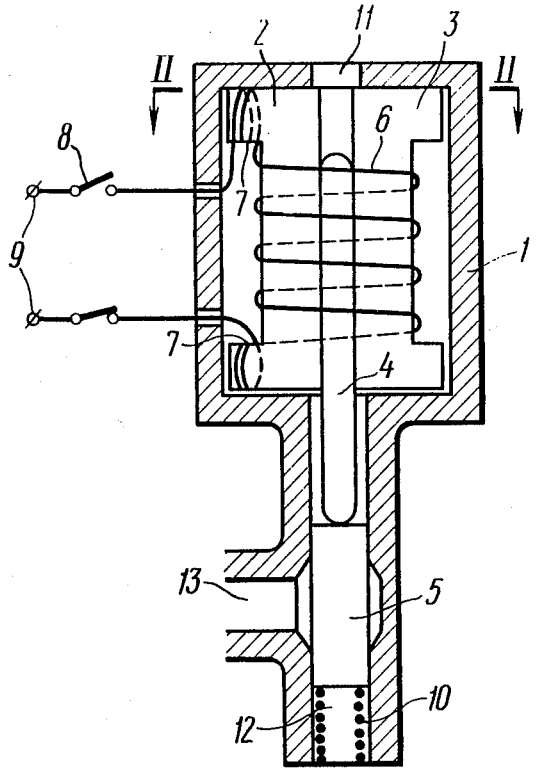
FIG. 1 is a schematic sectional view of an arrangement for retaining an actuating member in an extreme position, in accordance with the invention.
Figure 2:
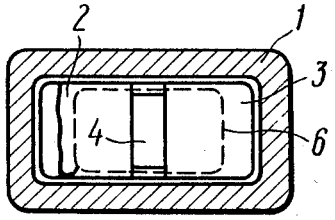
FIG. 2 is a sectional view taken along line II — II in FIG. 1.

Referring now in particular to the appended drawings, the arrangement includes a housing 1 (FIGS. 1 and 2). The housing 1 has mounted therein a pair of supports 2 and 3 receiving a connecting element 4 therebetween. The connecting element 4 is held in permanent engagement with an actuating member 5. The supports 2 and 3 are biased against the connecting element 4 by coils of wire 6 wound thereabout.

The actual number of the coils of the wire 6, the diameter thereof and the tension thereof are determined by the effort which is needed to retain the actuating member 5, which in the presently described embodiment is a valve member, in the extreme position thereof, i.e. in the fluid passage-closing position of the valve member.

The wire 6 is fixed on the support 2 by being wound about abutments 7 provided on the support. The opposite ends of the wire 6 are connected exteriorly of the housing 1 via a switch 8 to a power supply source 9, to effect selective heating of the wire.

The connecting element 4 is mounted so that one end bears upon the valve member 5, which is acted upon by a spring 10. The housing 1 has an opening 11 made therethrough, through which the opposite end of the element 4 may pass.

The arrangement according to the invention for retaining an actuating member in an extreme position thereof and for selectively releasing the actuating member operates, as follows.

As long as the valve member 5 is to be retained in the flow passage-closing position thereof, the wire 6 is disconnected from the power supply source 9.

The tensioned wire 6 presses the supports 2 and 3 against the connecting element 4 so that the latter is held thereby with an effort in excess of the opposing load of the valve member 5. The valve member 5 is acted upon by the effort of the spring 10 and by the pressure of the fluid.

To release the valve member 5, i.e. to let this valve member move through its working stroke, the switch 8 is operated to complete the electric circuit. Thus, the wire 6 heats up, whereby the elastic deformation of the wire, caused by its having been pre-tensioned, diminishes, and, consequently, the effort which holds together the supports 2 and 3 and the connecting element 4 sandwiched therebetween likewise diminishes. The valve member 5 is moved upward together with the connecting element 4 under the action of the spring 10 and the pressure of the fluid. The flow passage 12 now communicates with the flow passage 13, which means that the valve member 5 has been moved into the open position thereof.

A test sample of an arrangement constructed in accordance with the present invention and having dimensions 20 × 20 × 10 mm and total weight 30 grams has been found capable of retaining in an extreme position an actuating member loaded with an effort as great as several hundred kilograms.

All the component parts of the arrangement have been made by a simple die punching technique, which defines low manufacturing costs of such arrangments.

What we claim is:

1. An arrangement for retaining an actuating member in an extreme position thereof and for releasing the actuating member to perform a working stroke, comprising: a housing; a plurality of undeformable supports mounted within said housing in spaced relationship; an undeformable connecting element permanently cooperating with said actuating member, said connecting element being received between said supports; at least one coil of wire stressively wound about said supports to product elastic deformation of tension of the wire for urging said supports to engageably retain said connecting element with an effort sufficient to hold said actuating member in an extreme position thereof, said coil of wire being selectively connectable to a power supply source whereby when said wire is connected to the power supply the temperature of the wire increases resulting in reduced elastic deformation in the wire and said effort is reduced in magnitude so that said connecting element is released to be displaced relative to said supports and said actuating member is permitted to move through its working stroke.

* * * * *